US010007205B2

(12) United States Patent
Veregin et al.

(10) Patent No.: US 10,007,205 B2
(45) Date of Patent: Jun. 26, 2018

(54) STYRENE ACRYLATE HYBRID TONER PROCESS UTILIZING A LOW VOC (VOLATILE ORGANIC COMPOUND) COALESCENT AGENT IN TONER SHELLS

(71) Applicant: XEROX CORPORATION, Norwalk, CT (US)

(72) Inventors: Richard P N Veregin, Mississauga (CA); Valerie M. Farrugia, Oakville (CA); Nan-Xing Hu, Oakville (CA); Sandra J. Gardner, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days. days.

(21) Appl. No.: 14/794,756

(22) Filed: Jul. 8, 2015

(65) Prior Publication Data

US 2017/0010554 A1 Jan. 12, 2017

(51) Int. Cl.
*G03G 9/093* (2006.01)
*G03G 9/113* (2006.01)

(52) U.S. Cl.
CPC ..... *G03G 9/1131* (2013.01); *G03G 9/09328* (2013.01); *G03G 9/09371* (2013.01); *G03G 9/09392* (2013.01); *G03G 9/1133* (2013.01)

(58) Field of Classification Search
CPC .. G03G 9/0802; G03G 9/0804; G03G 9/0825; G03G 9/093
See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 4,298,672 | A | 11/1981 | Lu | |
| 4,338,390 | A | 7/1982 | Lu | |
| 6,063,827 | A | 5/2000 | Sacripante et al. | |
| 6,214,507 | B1 | 4/2001 | Sokol et al. | |
| 7,736,831 | B2 | 6/2010 | Lai et al. | |
| 2008/0063965 | A1* | 3/2008 | Lai | G03G 9/0804 430/108.1 |
| 2013/0059246 | A1* | 3/2013 | Hong | G03G 9/0821 430/109.4 |

* cited by examiner

*Primary Examiner* — Thorl Chea
(74) *Attorney, Agent, or Firm* — Pillsbury Winthrop Shaw Pittman LLP

(57) ABSTRACT

Disclosed herein include processes of preparing hybrid toner compositions with toner particles having a core-shell type structure, where the shell contains a non-volatile coalescent agent. More particularly, embodiments relate to processes of preparing styrene acrylate hybrid toner compositions.

20 Claims, 4 Drawing Sheets

STYRENE ACRYLATE HYBRID TONER PROCESS UTILIZING A LOW VOC (VOLATILE ORGANIC COMPOUND) COALESCENT AGENT IN TONER SHELLS

BACKGROUND

The present disclosure relates to processes of preparing hybrid toner compositions with toner particles having a core-shell type structure, where the shell contains a non-volatile (i.e., a low VOC (volatile organic compound)) coalescent agent. More particularly, embodiments herein relate to processes of preparing styrene acrylate hybrid toner compositions.

Hybrid toners having some of the polyester resin latex replaced by a styrene/acrylate latex is a key in facilitating future cost reduction for certain toner products. For example, hybrid toners may contain a styrene/acrylate shell and a core comprising a styrene-acrylate copolymer and amorphous polyester. By replacing the polyester with more styrene/acrylate copolymer, the cost is reduced as polyester is traditionally a more expensive material. Not only are the polyester raw materials generally more expensive, but to prepare polyester latex to enable use in emulsion-aggregation toner requires an additional processing step, which often requires the use of solvents, verses styrene/acrylate copolymers can be directly prepared as a latex when the resin is prepared by emulsion polymerization. However, the process of preparing these hybrid toners is challenging because the preparation of the styrene/acrylate shell requires higher temperature for coalescence compared to the polyester in the core. For example, a polyester emulsion/aggregation toner prepared by a batch process is generally coalesced at temperatures from about 70° C. to about 85° C., while a styrene/acrylate toner is generally coalesced at temperatures above 90° C., typically from 95 to 96° C.

A potential approach to address this mismatch is to elevate the coalescence temperature in the emulsion aggregation process to that typical from styrene/acrylates of about 95 to 96° C. However, depending on the Tg values of the styrene acrylate latex used in the shell, even with elevating the coalescence temperature may not be sufficient to enable a complete coalescence which leads to rough surface morphology of the toner particles, or may cause a loss of control of the toner particles during coalescence process resulting in poor particle properties, such as, toner particle size, toner particle shape, geometric size distribution (GSD), fines and coarse, as well as rejection of the styrene/acrylate latex, or rejection of other components, such as wax or pigment.

Thus, there exists a need to improve the coalescence of the styrene-acrylate to prepare hybrid toner particles. The inventors of the present disclosure discovered that by including a low VOC (volatile organic compound) coalescent agent in the toner shells can improve coalescence of the styrene-acrylate.

SUMMARY

According to embodiments illustrated herein, there is provided a process for preparing a hybrid toner having a core and a shell, comprising mixing a first latex comprising at least one styrene acrylate polymer resin, at least one amorphous polyester latex, an optional crystalline polyester latex, a wax, and an optional colorant to form a core mixture; optionally adding a coagulant to the core mixture; heating the core mixture to a temperature below the glass transition temperature of any of the at least one styrene acrylate polymer resin to aggregate the core mixture to form aggregated core particles; mixing a second latex comprising at least one styrene acrylate polymer resin and a coalescent agent to form a shell mixture; coating the shell mixture onto the aggregated core particles; heating the shell mixture and the aggregated core particles to a temperature above the glass transition temperature of any of the at least one styrene acrylate polymer resin to coalesce the aggregated core particles to form toner particles; and isolating the toner particles.

In certain embodiments, there is provided a process for preparing a hybrid toner having a core and a shell, comprising mixing a first latex comprising at least one styrene acrylate polymer resin, at least one amorphous polyester latex, an optional crystalline polyester latex, an optional colorant and an optional wax to form a core mixture; optionally adding a coagulant to the core mixture; heating the core mixture to a temperature below the glass transition temperature of any of the at least one styrene acrylate polymer resin to aggregate the core mixture to form aggregated core particles; mixing a second latex comprising at least one styrene acrylate polymer resin and 2,2,4-trimethyl-1,3-pentanediol monoisobutyrate to form a shell mixture; coating the shell mixture onto the aggregated core particles; heating the shell mixture and the aggregated core particles to a temperature above the glass transition temperature of any of the at least one styrene acrylate polymer resin to coalesce the aggregated core particles to form toner particles; and isolating the toner particles.

BRIEF DESCRIPTION OF THE DRAWINGS

For a better understanding of the present embodiments, reference may be made to the accompanying figures.

DETAILED DESCRIPTION

Figure 1:
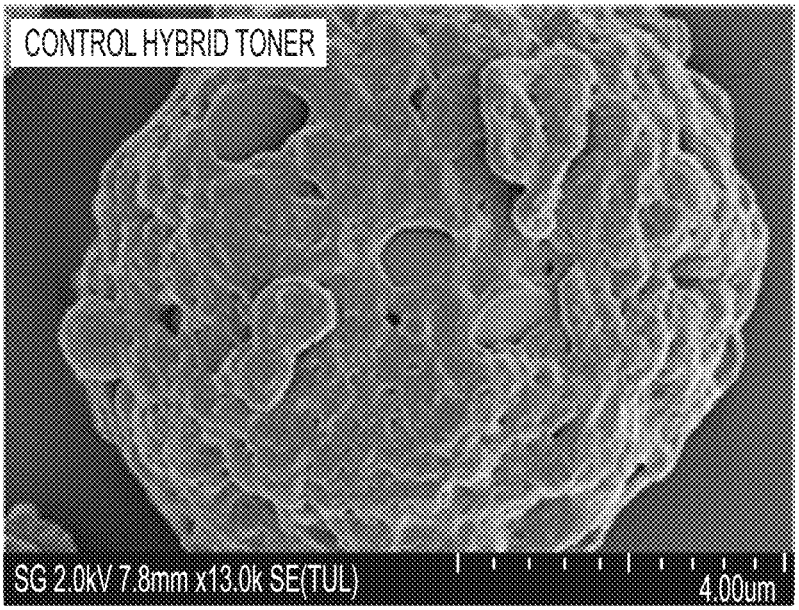
FIG. 1 shows a scanning electron microscope (SEM) image at ×13,000 magnification of toner surface of a Control Hybrid Toner.

In the following description, it is understood that other embodiments may be utilized and structural and operational changes may be made without departure from the scope of the present embodiments disclosed herein.

In this specification and the claims that follow, singular forms such as "a," "an," and "the" include plural forms unless the content clearly dictates otherwise. All ranges disclosed herein include, unless specifically indicated, all endpoints and intermediate values.

The present disclosure provides processes of preparing a hybrid toner having a core and a shell, wherein the shell contains a non-volatile (i.e., a low VOC (volatile organic compound)) coalescent agent.

The process includes preparing a core mixture (or core latex) and heating the core mixture to form aggregated core particles; preparing a shell mixture (or shell latex), coating the shell mixture onto the aggregated core particles; heating the shell mixture and the aggregated core particles to coalesce the aggregated core particles to form toner particles; and isolating the toner particles.

Preparing the core particles includes mixing (1) a first latex comprises at least one styrene acrylate polymer resin, at least one amorphous polyester latex, and an optional crystalline polyester latex; (2) a wax, and (3) an optional colorant to form a core mixture; optionally adding a coagulant to the core mixture; heating the core mixture to a temperature below the glass transition temperature of any of the at least one styrene acrylate polymer resin to aggregate the core mixture to form aggregated core particles.

Preparing the toner shell includes mixing a second latex comprising at least one styrene acrylate polymer resin and a coalescent agent to form a shell mixture.

Lastly, the toner particles are obtained by coating the shell mixture onto the aggregated core particles; heating the shell mixture and the aggregated core particles to a temperature below the glass transition temperature of any of the at least one styrene acrylate polymer resin to coalesce the aggregated core particles to form toner particles.

The toner of the present disclosure can be prepared by emulsion aggregation (EA). The low VOC coalescent agent may be incorporated into the toner shell during the emulsion polymerization stage. Emulsion polymerization is a technique used in forming polymers in which monomers are diffused into a micelle where free radical polymerization proceeds with the resulting formation of polymer particles. The coalescent agent may be mixed with a polymeric resin (i.e., a second latex) to form a shell mixture. The second latex contains at least one styrene acrylate polymer resin. By incorporating the coalescence agent to the second latex not only ensures that the coalescence agent is homogeneously distributed within the shell mixture, but also localizes the coalescence agent in the thereby formed toner shell. The low VOC coalescence agent diffuses into the shell mixture (or shell latex), and thus being encapsulated within the shell latex. During the coalescence, partial of the coalescent agent may further diffuse into the substrate, resulting in a hard robust toner coating.

The processes of the present disclosure are different from the processes disclosed in U.S. Pat. No. 7,736,831 (thereafter "the '831 patent"), which include adding a coalescence agent into the toner after aggregation and prior to coalescence. The processes of the '831 patent provide toner compositions which contain a coalescent agent that is mixed into the entire toner, not only in the toner shell as described in the present disclosure. Having the coalescent agent presented only in the toner shell is important in the preparation process of a hybrid toner, particularly in the preparation process of a styrene acrylate hybrid toner, to obtain a smooth shell surface for the hybrid toner while not significantly affecting the core of the toner, which contains some polyester resin. During the emulsion/aggregation coalescence step, the polyester resin in the core exhibits relatively low viscosity while the styrene-acrylate shell exhibits relatively high viscosity. Thus, if the coalescent agent is included in the toner core it causes difficulty for the shell to encapsulate the polyester resin in the core. In addition, with the presence of the coalescent agent in the core, the shell may not flow well at the coalescence temperature due to its relatively high viscosity, which may lead to the sticking of the toner particles among themselves. Including a coalescent agent to solely in the shell (i.e., not included in the core) has little effect on the viscosity of the polyester in the core, and therefore has little effect on the overall toner process. This is because the coalescent agent which presented solely in the shell is effective to lower the viscosity of the styrene/acrylate in the shell, enabling the shell to coalesce very smoothly at the desired coalescence temperature.

The coalescent agent to be incorporated in the toner shell of the hybrid toner of the present disclosure has a high boiling point at atmospheric pressure of from about 250° C. to about 450° C., from about 250° C. to about 350° C., or from about 250° C. to about 400° C.

In embodiments, the coalescent agent has a volatility of from about $10^{-8}$ to about $10^{-2}$ mmHg, from about $10^{-8}$ to about $10^{-3}$ mm Hg, from about $10^{-6}$ to about $10^{-2}$ mm Hg at 20° C.

In embodiments, the coalescent agent is insoluble in water. In embodiments, the coalescent agent has solubility in water of below about 0.5 weight percent, or from 0 to about 0.2 weight percent, or from 0 to about 0.15 weight percent at 20° C.

In embodiments, the coalescent agent contains at least one ester linkage. In embodiments, the coalescent agent is an organic compound containing from 8 to 20 carbon atoms, from 10 to 15 carbon atoms, or from 8 to 25 carbon atoms. The coalescent agent may include TEXANOL® available from Eastman Chemical Company (2,2,4-trimethyl-1,3-pentanediol monoisobutyrate, or IUPAC: 3-hydroxy-2,2,4-trimethylpentyl 2-methylpropanoate), 2,2,4-trimethyl-1,3-pentanediol diisobutyrate, 2,2,4-Trimethyl-1,3-Pentanediol Monoisobutyrate, triethylene glycol di-2-ethylhexanoate, benzyl benzoate, diethylene glycol dibenzoate or IUPAC: 2-[2-(benzoyloxy)ethoxy]ethyl benzoate, 3-phenylpropyl benzoate, dipropylene glycol dibenzoate, propylene glycol dibenzoate or mixtures thereof.

Two or more coalescent agents may be mixed with the second latex. When two coalescent agents are used, the ratio of the two coalescent agents may be from about 1:5 to about 5:1, from about 1:3 to about 3:1, or from about 1:2 and to about 2:1. When three coalescent agents are used, the amount of the third coalescent agent may equal to or less than the amount of any of one of the first two coalescent agents.

Table 1 below lists some example of coalescent agent suitable for use according to the embodiments of the present disclosure.

| Type | Boiling Point, ° C. at atmospheric | Vapor Pressure, mmHg at 20° C. | Solubility Parameter (Hildebrands) | Water Solubility |
|---|---|---|---|---|
| 2,2,4-Trimethyl-1,3-pentanediol monoisobutyrate | 253 | $1 \times 10^{-2}$ | 9.3 | Insoluble |
| 2,2,4-Trimethyl-1,3-pentanediol diisobutyrate | 285 | $<1 \times 10^{-2}$ | 8.2 | Insoluble |
| Triethylene glycol di-2-ehtylhexanoate | 344 | $<1 \times 10^{-3}$ | 8.5-8.7 | Insoluble |

-continued

| Type | Boiling Point, ° C. at atmospheric | Vapor Pressure, mmHg at 20° C. | Solubility Parameter (Hildebrands) | Water Solubility |
|---|---|---|---|---|
| Benzyl benzoate | 323 | $8 \times 10^{-3}$ | 10.1 | Insoluble |
| 3-Phenylpropyl benzoate | 343 | $5.0 \times 10^{-5}$ | 9.6 | Insoluble |
| Diethylene and dipropylene glycol dibenzoate (3:1) | >330 | $9.0 \times 10^{-5}$ | 9.8 | Insoluble |
| Propylene, dipropylene and diethylene glycol dibenzoate (1:1:3) | >350 | $3.6 \times 10^{-6}$ | 9.9 | Insoluble |
| Lower VOC blend of diethylene and dipropylene glycol dibenzoate (3:2) | >350 | $1.0 \times 10^{-8}$ | 9.8 | Insoluble |

The amount of the coalescent agent used in mixing with the second latex to prepare the shell mixture is from about from about 0.1 to about 5.0 percent by weight, from about 0.5 to about 1.0 percent by weight, or from about 0.5 to about 2.0 percent by weight, based on the solid content in the shell mixture.

The majority of the coalescent agent (e.g., at least 95% by weight of the total weight of the coalescent agent used) does not evaporate during subsequent processing, such that the coalescent agent is present in the final prepared hybrid toner particles in an amount of from about 0.01 to about 2.0 percent by weight, from about 0.05 to about 0.3 percent by weight, or from about 0.1 to about 1.0 percent by weight, based on the final dry weight of the hybrid toner particles.

Polymeric Resin

The first and second latexes may be the same or different. The first latex contains at least one styrene acrylate polymer resin. The second latex contains at least one styrene acrylate polymer resin. The at least one styrene acrylate polymer resin in the first latex and that in the second latex may be the same or different.

Illustrative examples of specific polymers for the first and second latexes include, for example, poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and other similar polymers. The alkyl group in the aforementioned polymers may be any alkyl group, and in particular may be a $C_1$-$C_{12}$ alkyl group, for example including methyl, ethyl, propyl and butyl. As the aryl group, any aryl group known in the art may be used.

Amorphous Polyester Resin

The toner composition of the present disclosure include core particles comprises an amorphous polyester resin. The amorphous polyester resin may be formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin. In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

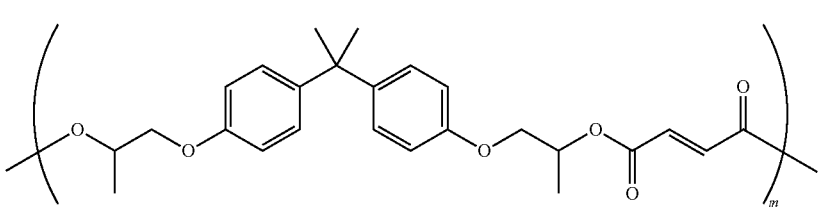

(I)

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

In embodiments, the resins utilized as the resin coating may have a glass transition temperature of from about 30° C. to about 80° C., in embodiments from about 35° C. to about 70° C. In further embodiments, the resins utilized as the resin coating may have a melt viscosity of from about 10 to about 1,000,000 Pa*S at about 130° C., in embodiments from about 20 to about 100,000 Pa*S.

Crystalline Polyester Resin

The crystalline resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly(propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Optional Additives

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin described above or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with the shell resin described above or after application of the shell resin.

Wax

A wax may be included in the core and/or shell particles of the toner. The wax can include any of the various waxes conventionally used in emulsion aggregation toner compositions. Suitable examples of waxes include polyethylene, polypropylene, polyethylene/amide, polyethylenetetrafluoroethylene, and polyethylenetetrafluoroethylene/amide. Other examples include, for example, polyolefin waxes, such as polyethylene waxes, including linear polyethylene waxes and branched polyethylene waxes, and polypropylene waxes, including linear polypropylene waxes and branched polypropylene waxes; paraffin waxes; Fischer-Tropsch waxes; amine waxes; silicone waxes; mercapto waxes; polyester waxes; urethane waxes; modified polyolefin waxes (e.g., a carboxylic acid-terminated polyethylene wax or a carboxylic acid-terminated polypropylene wax); amide waxes, such as aliphatic polar amide functionalized waxes; aliphatic waxes consisting of esters of hydroxylated unsaturated fatty acids; high acid waxes, such as high acid montan waxes; microcrystalline waxes, such as waxes derived from distillation of crude oil; and the like. By "high acid waxes" it is meant a wax material that has a high acid content. The waxes can be crystalline or non-crystalline, as desired, although crystalline waxes are preferred, in embodiments. By "crystalline polymeric waxes" it is meant that a wax material contains an ordered array of polymer chains within a polymer matrix that can be characterized by a crystalline melting point transition temperature, Tm. The crystalline melting temperature is the melting temperature of the crystalline domains of a polymer sample. This is in contrast to the glass transition temperature, Tg, which characterizes the temperature at which polymer chains begin to flow for the amorphous regions within a polymer.

To incorporate the wax into the toner, it is desirable for the wax to be in the form of one or more aqueous emulsions or dispersions of solid wax in water, where the solid wax particle size is usually in the range of from about 100 to about 500 nm.

The toners may contain the wax in any amount of from, for example, about 3 to about 15% by weight of the toner, on a dry basis. For example, the toners can contain from about 5 to about 11% by weight of the wax.

Colorant

The toners may contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1% to about 25% by weight based upon the total weight of the composition. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow 00790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, ED. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra(octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1% to about 35% by weight of the toner particles on a solids basis, such as from about 5% to about 25% by weight or from about 5 to about 15% by weight. However, amounts outside these ranges can also be used, in embodiments.

Coagulant

The toners of the present disclosure may also contain a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from 0 to about 5% by weight of the toner particles, such as from about greater than 0 to about 3% by weight of the toner particles In preparing the toner by the emulsion aggregation procedure, one or more surfactants may be used in the process. Suitable surfactants include anionic, cationic and nonionic surfactants. In embodiments, the use of anionic and nonionic surfactants are preferred to help stabilize the aggregation process in the presence of the coagulant, which otherwise could lead to aggregation instability.

Anionic surfactants include sodium dodecylsulfate (SDS), sodium dodecyl benzene sulfonate, sodium dodecylnaphthalene sulfate, dialkyl benzenealkyl, sulfates and sulfonates, abitic acid, and the NEOGEN brand of anionic surfactants. An example of a suitable anionic surfactant is NEOGEN RK available from Daiichi Kogyo Seiyaku Co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecyl benzyl triethyl ammonium chloride. MIRAPOL and ALKAQUAT available from Alkaril Chemical Company, SANISOL (benzalkonium chloride), available from Kao Chemicals, and the like. An example of a suitable cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of the acids that can be utilized include, for example, nitric acid, sulfuric acid, hydrochloric acid, acetic acid, citric acid, trifluro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

The process of the present disclosure may be an emulsion aggregation procedure for forming the emulsion aggregation toner particles. The process includes aggregating an emulsion containing polymer binder (i.e., a first latex including at least one amorphous polyester latex, and an optional crystalline polyester latex), an optional colorants, a wax, an optional surfactant, an optional coagulant, and an optional additive to form aggregates of core particles, and subsequently preparing a shell mixture which includes mixing the described coalescent agent and a second latex to form a shell mixture; coating the shell mixture onto the aggregated core particles, subsequently coalescing or fusing the aggregates, and then recovering, optionally washing, optionally cooling, optionally drying the obtained emulsion aggregation toner particles, and isolating the toner particles.

In embodiments, the mixing of the first latex, a wax, an optional colorant, and an optional coagulant results in a core mixture having a pH of, for example, about 2.0 to about 4.0, which is aggregated by heating to a temperature below the polymer resin Tg to provide toner size aggregates. In embodiments, the heating of the core mixture may be conducted at a temperature of from about 40 to about 60° C., from about 45 to about 50° C., or from about 40 to about 55° C. In embodiments, the core mixture may be heated for from about 15 minutes to 120 minutes, from about 15 minutes to 30 minutes, or from about 15 minutes to 60 minutes.

A second latex may then be mixed with a coalescent agent to form a shell mixture. The pH of the shell mixture may be then adjusted, for example by the addition of a base, such as sodium hydroxide solution or the like, until a pH of about 6.5-8.0 is achieved. The resulting shell mixture may be coated onto the surface of the aggregated core particles thus providing a shell over the formed aggregates. Subsequently, the shell mixture and the aggregated core particles may be heated to a temperature above the glass transition temperature of any of the at least one styrene acrylate polymer resin of the second latex to coalesce the aggregated core particles to form toner particles. In embodiments, the heating of the shell mixture and the aggregated core particles may be conducted at a temperature of from about 65 to about 90° C., from about 70 to about 85° C., or from about 75 to about 85° C.

In embodiments, the shell mixture and the aggregated core particles may be heated for from about 15 minutes to 480 minutes, from about 30 minutes to 360 minutes, or from about 90 minutes to 480 minutes.

The fused particles can be measured for shape factor or circularity, such as with a Sysmex FPIA 2100 analyzer, until the desired shape is achieved.

The resulting toner particles may be allowed to cool to room temperature (about 20° C. to about 25° C.) which may be rapidly cooled by using a quenching technique well done in the art; and are optionally washed to remove any additive or surfactant. The toner particles are then optionally dried.

The toner particles of the present disclosure can be made to have the following physical properties when no external additives are present on the toner particles.

The toner particles can have a surface area, as measured by the BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.15 to approximately 1.30, or approximately less than 1.25. The toner particles of the present disclosure also can have a size such that the upper geometric standard deviation (GSD) by volume is in the range of from about 1.15 to about 1.30, such as from about 1.18 to about 1.22, or less than 1.25. These GSD values for the toner particles of the present disclosure indicate that the toner particles are made to have a very narrow particle size distribution.

Shape factor is also a control process parameter associated with the toner being able to achieve optimal machine performance. The toner particles can have a shape factor of about 105 to about 170, such as about 110 to about 160, SF1*a. Scanning electron microscopy (SEM) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular bases. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.940 to about 0.980.

In addition to the foregoing, the toner particles of the present disclosure also have the following rheological and flow properties. First, the toner particles can have the following molecular weight values, each as determined by gel permeation chromatography (GPC) as known in the art. The binder of the toner particles can have a weight average molecular weight, Mw of from about 15,000 daltons to about 90,000 daltons.

Overall, the toner particles in embodiments have a weight average molecular weight (Mw) in the range of about 17,000 to about 60,000 daltons, a number average molecular weight (Mn) of about 9,000 to about 18,000 daltons, and a MWD of about 2.1 to about 10. MWD is a ratio of the Mw to Mn of the toner particles, and is a measure of the polydispersity, or width, of the polymer. For cyan and yellow toners, the toner particles in embodiments can exhibit a weight average molecular weight (Mw) of about 22,000 to about 45,000 daltons, a number average molecular weight (Mn) of about 9,000 to about 13,000 daltons, and a MWD of about 2.2 to about 10. For black and magenta, the toner particles in embodiments can exhibit a weight average molecular weight (Mw) of about 22,000 to about 45,000 daltons, a number average molecular weight (Mn) of about 9,000 to about 13,000 daltons, and a MWD of about 2.2 to about 10.

Specific embodiments will now be described in detail. These examples are intended to be illustrative, and the claims are not limited to the materials, conditions, or process parameters set forth in these embodiments. All parts and percentages are by weight unless otherwise indicated.

EXAMPLES

Example 1

Preparation of Latex with 1% Texanol

The shell latex (126.50 g, styrene-acrylate latex C, an emulsion polymerized latex of about 220 nm size with 75% styrene and 25% nBA, a Mw of 55,000 and a Tg onset of about 55° C., and about 40% solids) is pre-mixed with 1% Texanol™ (0.51 g, Sigma Aldrich) for about 2 hours in a 250 ml beaker with stirring at 250 rpm using a magnetic stir bar.

Example 2

Preparation of Hybrid Toner Control

In a 2 L reactor, 82.64 g of amorphous polyester emulsion A having an Mw of about 19,400, an Mn of about 5,000, a Tg onset of about 60° C., and about 35% solids, 82.64 g of amorphous polyester emulsion B having an average molecular weight (Mw) of about 86,000, a number average molecular weight (Mn) of about 5,600, an onset glass transition temperature (Tg onset) of about 56° C., and about 35% solids, 16.07 g styrene-acrylate emulsion polymerized latex C of about 220 nm size with 75% styrene and 25% nBA, a Mw of 55,000 and a Tg onset of about 55° C., and about 40% solids, 29.16 g crystalline polyester emulsion D having an Mw of about 23,300, an Mn of about 10,500, a melting temperature (Tm) of about 71° C. and about 35.4% solids; 45.94 g polyethylene wax in an emulsion, having a Tm of about 90° C., and about 30% solids; 9.55 g cyan pigment (PB15:3), 57.6 g black pigment (Nipex®-35) and 404.50 g DI water were combined to form a slurry. Subsequently, 2.69 g of PAC (poly-aluminum chloride) was mixed with 33.21 g of 0.02M nitric acid and then added to the slurry under homogenization at 3000-4000 RPM and the pH was adjusted from 5.03 to 3.75 with 0.3M nitric acid. The reactor was set to 275 RPM and was heated to 45° C. to aggregate the toner particles. When the toner particle size reached 4.8-5 μm, a shell coating was added which contained 126.50 g styrene-acrylate latex C. The reaction was further heated to 50° C. When the toner particle size reached 5.6-6 microns, freezing began with the pH of the slurry being adjusted to 4.88 using 14.21 g of a 4% NaOH solution. The reactor RPM was then decreased to 230 followed by the addition of 5.77 grams of a chelating agent (Versene100) and 2.33 g of a 4% NaOH solution until pH reached 7.66. The reactor temperature was ramped to 76° C. Once the temperature reached 76° C., the pH of the slurry was reduced from 7.26 to 5.07 with 59.66 g 0.3M nitric acid. The reactor temperature was further ramped to 86° C. Once the temperature reached the coalescence temperature, the slurry was coalesced for about 70 minutes The slurry was then quenched and cooled in 714 g DI ice. The final particle size was 6.61 microns, GSDv 1.12, GSDn 1.40 and a circularity of 0.977 as measured by the Flow Particle Image Analysis (FPIA) instrument. The toner was then washed and freeze-dried.

Example 3

Preparation of Disclosure Hybrid Toner Containing 1% Texanol in the Toner Shell

In a 2 L reactor, 82.64 g of amorphous polyester emulsion A 82.64 g of amorphous polyester emulsion B, 16.07 g styrene-acrylate latex C, 29.16 g crystalline polyester emulsion D, 45.94 g polyethylene wax in an emulsion, having a Tm of about 90° C., and about 30% solids; 9.55 g cyan pigment (PB15:3), 57.6 g black pigment (Nipex®-35) and 404.50 g DI water were combined to form a slurry. Subsequently, 2.69 g of PAC (poly-aluminum chloride) was mixed with 33.21 g 0.02M nitric acid and then added to the slurry under homogenization at 3000-4000 RPM and the pH is adjusted from 5.00 to 3.75 with 0.3M nitric acid. The reactor is set to 280 RPM and was heated to 45° C. to aggregate the toner particles. When the toner particle size reached 4.8-5 μm, a shell coating was added which contained 126.50 g styrene-acrylate latex C and 0.51 g 1% Texanol prepared in Example 1 as described above. The reaction was further heated to 50° C. When the toner particle size reached 5.6-6 microns, freezing began with the pH of the slurry being adjusted to 5.02 using 23.11 g of a 4% NaOH solution. The reactor RPM was then decreased to 185 followed by the addition of 5.77 grams of a chelating agent (Versene100) until pH reaches 7.70. The reactor temperature was ramped to 74° C. Once the temperature reached 74° C., the pH of the slurry was reduced from 7.16 to 4.79 with 36.04 g 0.3M nitric acid. The reactor temperature was further ramped to 86° C. Once the temperature reached the coalescence temperature, the slurry was coalesced for about 95 minutes. The slurry was then quenched and cooled in 732 g DI ice. The final particle size was 6.75 microns, GSDv 1.20, GSDn 1.23 and a circularity of 0.976 as measured by the Flow Particle Image Analysis (FPIA) instrument. The toner was then washed and freeze-dried.

Example 4

Preparation of Latex with 5% Texanol

The shell latex (126.50 g, styrene-acrylate latex C) is pre-mixed with about 5% Texanol™ (for Example 5: 2.55 g; for Example 6: 2.14 g, Sigma Aldrich) for about 2 hours in a 250 ml beaker with stirring at 250 rpm using a magnetic stir bar.

Example 5

Preparation of Disclosure Hybrid Toner Containing 5% Texanol in the Toner Shell

In a 2 L reactor, 82.64 g of amorphous polyester emulsion A 82.64 g of amorphous polyester emulsion B, 16.07 g styrene-acrylate latex C, 29.16 g crystalline polyester emulsion D, 45.94 g polyethylene wax in an emulsion, having a Tm of about 90° C., and about 30% solids; 9.55 g cyan pigment (PB15:3), 57.6 g black pigment (Nipex®-35) and 404.50 g DI water were combined to form a slurry. Subsequently, 2.69 g of PAC (poly-aluminum chloride) was mixed with 33.21 g 0.02M nitric acid and then added to the slurry under homogenization at 3000-4000 RPM and the pH is adjusted from 5.00 to 3.00 with 0.3M nitric acid. The reactor is set to 310 RPM and was heated to 45° C. to aggregate the toner particles. When the toner particle size reached 4.8-5 μm, a shell coating was added which contained 126.50 g styrene-acrylate latex C and 2.55 g 5% Texanol prepared in Example 4 as described above. The reaction was further heated to 50° C. When the toner particle size reached 5.6-6 microns, freezing began with the pH of the slurry being adjusted to 4.89 using 20.79 g of a 4% NaOH solution. The reactor RPM was then decreased to 192 followed by the addition of 5.77 grams of a chelating agent (Versene100) until pH reaches 7.71. The reactor temperature was ramped to 74° C. Once the temperature reached 74° C., the pH of the slurry was reduced from 7.16 to 4.79 with 33.88 g 0.3M nitric acid. The reactor temperature was further ramped to 86° C. Once the temperature reached the coalescence temperature, the slurry was coalesced for about 110 minutes. The slurry was then quenched and cooled in 794 g DI ice. The final particle size was 7.34 microns, GSDv 1.21, GSDn 1.21 and a circularity of 0.973 as measured by the Flow Particle Image Analysis (FPIA) instrument. The toner was then washed and freeze-dried.

Example 6

Preparation of Disclosure Hybrid Toner Containing 5% Texanol in the Toner Shell

In a 2 L reactor, 94.12 g of amorphous polyester emulsion A 94.12 g of amorphous polyester emulsion B, 18.20 g styrene-acrylate latex C, 29.16 g crystalline polyester emulsion D, 45.94 g polyethylene wax in an emulsion, having a Tm of about 90° C., and about 30% solids; 9.55 g cyan pigment (PB15:3), 57.6 g black pigment (Nipex®-35) and 450.07 g DI water were combined to form a slurry. Subsequently, 2.69 g of PAC (poly-aluminum chloride) was mixed with 33.21 g 0.02M nitric acid and then added to the slurry under homogenization at 3000-4000 RPM and the pH is adjusted from 5.00 to 3.00 with 0.3M nitric acid. The reactor is set to 320 RPM and was heated to 44° C. to aggregate the toner particles. When the toner particle size reached 4.8-5 μm, a shell coating was added which contained 103.60 g styrene-acrylate latex C and 2.14 g 5% Texanol prepared in Example 4 as described above. The reaction was further heated to 50° C. When the toner particle size reached 5.6-6 microns, freezing began with the pH of the slurry being adjusted to 4.72 using 15.13 g of a 4% NaOH solution. The reactor RPM was then decreased to 208 followed by the addition of 5.77 grams of a chelating agent (Versene100) until pH reaches 7.29. The reactor temperature was ramped to 70° C. Once the temperature reached 70° C., the pH of the slurry was reduced from 7.02 to 5.03 with 39.47 g 0.3M nitric acid. The reactor temperature was further ramped to 83° C. Once the temperature reached the coalescence temperature, the slurry was coalesced for about 42 minutes. The slurry was then quenched and cooled in 757 g DI ice. The final particle size was 5.96 microns, GSDv 1.20, GSDn 1.21 and a circularity of 0.985 as measured by the Flow Particle Image Analysis (FPIA) instrument. The toner was then washed and freeze-dried.

Example 7

Toner Particle Properties and Performance

The toner particle properties and performance of the Control Hybrid Toner and the three Disclosure Hybrid Toners are compared and summarized in Table 1 below. The Disclosure Hybrid Toners with the addition of 1% Texanol® or 5% Texanol® containing latex in the shell resulted in a better GSDn compared to the Control Hybrid Toner. The Control Hybrid Toner exhibits a GSDn=1.40, which is not acceptable. The total of the overall fines was also less for all three disclosure hybrid toners. However, the particle size of the Disclosure Hybrid toner of Example 5 was larger than the others, this can result in an apparent reduction in fines. The toner was remade in Example 6 with some changes to the process conditions and provides a somewhat smaller size than the toners of the other examples, and also has very low fines, showing that the improved fine in Examples 5 and 6 are not caused by the smaller particle size for the toner with 5% Texanol® in the shell.

Toner Fusing Evaluation

Fusing characteristics of the toners produced were determined by crease area, minimum fixing temperature, gloss, hot offset temperature (HOT) and mottle temperature.

All unfused images were generated using a modified Xerox copier. A TMA (Toner Mass per unit Area) of 1.00 $mg/cm^2$ was used for the amount of toner placed onto CXS paper (Color Xpressions Select, 90 gsm, uncoated, Xerox P/N 3R11540) and used for gloss, crease and hot offset measurements. Gloss/crease targets were a square image placed in the centre of the page.

Samples were then fused with an oil-less fusing fixture, consisting of a Xerox® 700 production fuser CRU that was fitted with an external motor and temperature control along with paper transports. Process speed of the fuser was set to 220 mm/s (nip dwell of ~34 ms) and the fuser roll temperature was varied from cold offset to hot offset or up to 210° C. for gloss and crease measurements on the samples. After the set point temperature of the fuser roll has been changed I wait ten minutes to allow the temperature of the belt and pressure assembly to stabilize.

Crease Area

The toner image displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 correspond to about 1 mm in width.

Minimum Fixing Temperature

The Minimum Fixing Temperature (MFT) measurement involves folding an image on paper fused at a specific temperature, and rolling a standard weight across the fold. The print can also be folded using a commercially available folder such as the Duplo D-590 paper folder. The folded image is then unfolded and analyzed under the microscope and assessed a numerical grade based on the amount of crease showing in the fold. This procedure is repeated at various temperatures until the minimum fusing temperature (showing very little crease) is obtained.

Gloss

Print gloss (Gardner gloss units or "ggu") was measured using a 75.degree. BYK Gardner gloss meter for toner images that had been fused at a fuser roll temperature range of about 120° C. to about 210° C.

Gloss Mottle

The gloss mottle temperature is the temperature at which the print shows a mottled texture, characterized by non-uniform gloss on the mm scale on the print, and is due to the toner beginning to stick to the fuser in small areas.

Hot Offset

The hot offset temperature (HOT) is that temperature that toner that has contaminated the fuser roll is seen to transfer back onto paper. To observe it a blank piece of paper, a chase sheet, is sent through the fuser right after the print with the fused image. If an image offset is notice on the blank chase sheet at a certain fuser temperature then this is the hot offset temperature Fusing Evaluation Results Fusing results are shown in Table 1 for the Control Hybrid Toner and the Disclosure Hybrid Toners of Example 3 and Example 5. When Texanol is added to the shell the temperature required to reach a gloss of 40 is reduced substantially, from 157 to 151 with 1% Texanol and then 144 with 5% Texanol. Similarly the MFT temperature is also reduced substantially, especially when more Texanol is added. At the same time the HOT temperature remains good to the highest temperature tested of 210° C. There is only a slightly lower mottle temperature for both toners with Texanol, but mottle is only seen at the upper limit of the test at the highest temperature of 210° C., which is acceptable. Thus, with the addition of Texanol the toner is able to fuse to acceptable crease and gloss at a much lower temperature, with almost no change in the upper temperature limit for fusing. Also, the peak gloss increases with increasing amount of Texanol added to the shell.

Toner Developer Evaluation

Bench developer performance was obtained for both the parent toner particles, without any external toner additives and of a toner blended with a set of external additives.

Toner Additive Blending

For each sample, about 50 g of the toner were added to an SKM mill along with an additive package including silica, titania and zinc stearate and then blended for about 30 seconds at approximately 12500 rpm. Surface additives were 1.29% RY50L silica, 0.86% RX50 silica, 0.88% STT100H titania, 1.73% X24 sol-gel colloidal silica, and 0.18% zinc stearate, 0.5% PMMA and 0.28% cerium oxide particles.

Toner Charging

Toner charging was collected for both the parent toner particle without any surface additives and for the blended toner particle with surface additives. For parent toner particles 5 pph of toner in carrier was prepared, 1.5 grams of toner and 30 grams of XEROX® 700 carrier in a 60 mL glass bottle, for the blended toner at 6 pph of toner in carrier, 1.8 grams of toner and 30 grams of Xerox 700 carrier in a 60 mL glass bottle. Samples were conditioned three days in a low-humidity zone (J zone) at 21.1° C. and 10% RH), and in a separate sample in a high humidity zone (A zone) at about 28° C./85% relative humidity. The developers with parent toner particles were charged in a Turbula mixer for 10 minutes, the developers with additive blended toner were charged in a Turbula mixer for 60 minutes.

Toner Evaluation Results

The parent toner charging as shown in Table 1 is similar for the Hybrid Control Toner and the two Disclosure Hybrid toners with either 1% or 5% Texanol in the shell, and all are acceptable. For the blended toners both the Disclosure Hybrid toners with either 1% or 5% Texanol in the shell have higher charge in both A-zone and J-zone. This may be due to the better morphology of the toner surface, which allows the additives to be more effective in controlling the toner charge. In some embodiments a higher charge in both zones may be desirable, in other embodiments it could lead to lower density image. However, if the higher charge is not desired, the loading of the toner surface additives could be reduced.

TABLE 1

| | Example 2 | | Example 3 | | Example 5 | | Example 6 |
|---|---|---|---|---|---|---|---|
| Toner property | Control hybrid toner | | Disclosure hybrid toner with 1% Texanol | | Disclosure hybrid toner with 5% Texanol | | Disclosure hybrid toner with 5% Texanol |
| Coalescence time/temperature | 70'/86° C. | | 95'/86° C. | | 110'/86° C. | | 110'/86° C. |
| Size (μm)/GSDn/GSDv | 6.62/1.20/1.40 | | 6.75/1.20/1.23 | | 7.34/1.21/1.21 | | 5.96/1.20/1.21 |
| Fines: 1.41-3.15 μm | 10.7% | | 14.3% | | 3.5% | | 3.09% |
| Circularity | 0.977 | | 0.976 | | 0.973 | | 0.985 |
| Gloss 40 Temperature | 157° C. | | 151° C. | | 144° C. | | No data |
| Peak Gloss | 54.8 gu | | 58 gu | | 61 gu | | No data |
| Crease MFT temperature | 131° C. | | 128° C. | | 123° C. | | No data |
| Mottle/HOT temperature | >210° C./>210° C. | | 210° C./>210° C. | | 210° C./>210° C. | | No data |
| Parent particle charge J-zone/A-zone (μC/g) | 85 | 10 | 75.3 | 80 | 80 | 16.4 | No data |
| Blended toner charge J-zone/A-zone (μC/g) | 48 | 18 | 65.8 | 65 | 65 | 23.8 | No data |

Figure 2:
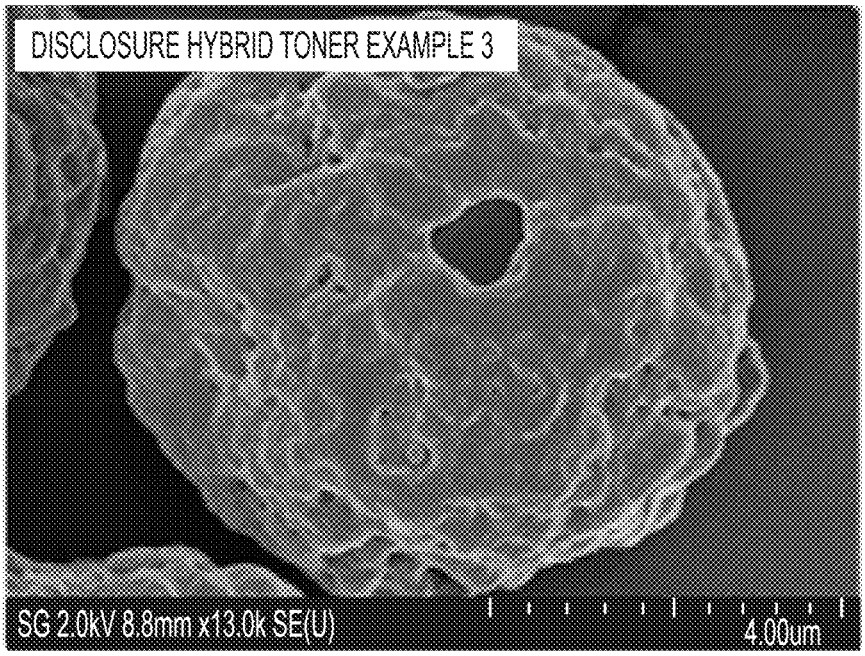
FIG. 2 shows a scanning electron microscope (SEM) image at ×13,000 magnification of the toner surface of a Disclosure Hybrid Toner with 1% Texanol.
Figure 3:
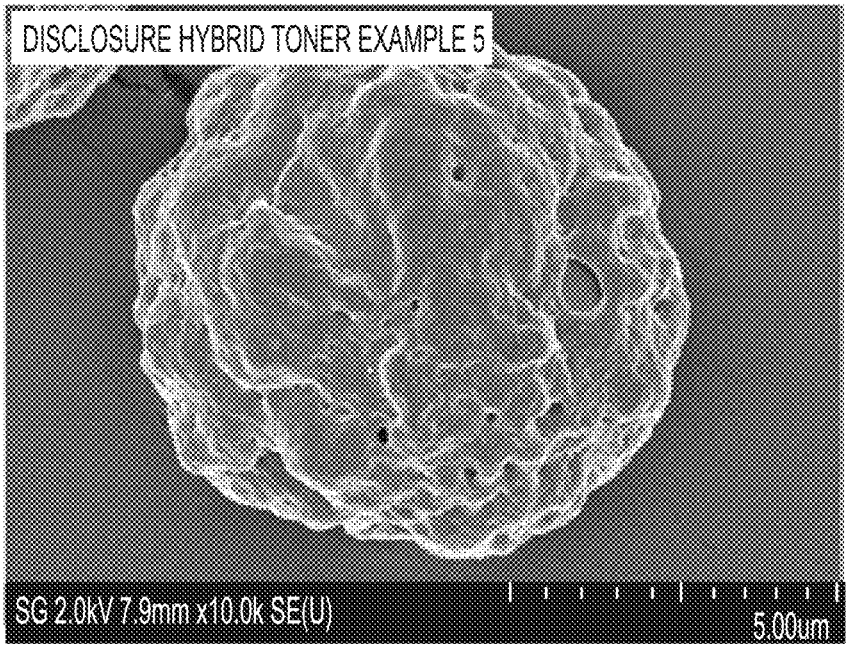
FIG. 3 shows a scanning electron microscope (SEM) image at ×10,000 magnification of the toner surface of a Disclosure Hybrid Toner with 5% Texanol.
Figure 4:
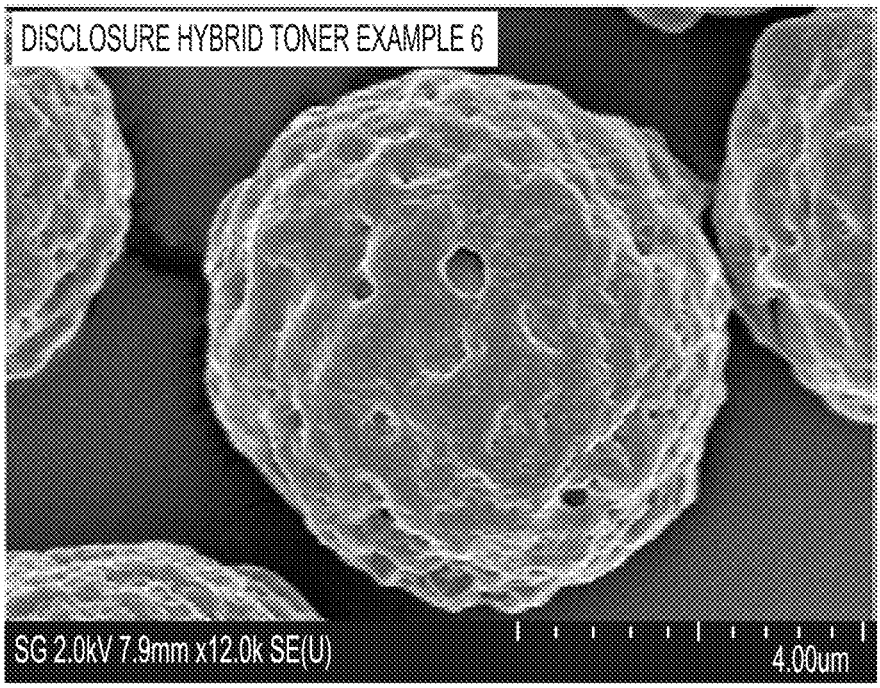
FIG. 4 shows a scanning electron microscope (SEM) image at ×12,000 magnification of the toner surface of a Disclosure Hybrid Toner with 5% Texanol.

FIG. 1 shows a scanning electron microscope (SEM) image at ×13,000 magnification, of toner surface of the Control Hybrid Toner of Example 2. FIG. 2 shows an SEM image 13,000× magnification,) of the toner surface of the Disclosure Hybrid Toner of Example 3. FIG. 3 shows an SEM image at 10,000× magnification of the toner surface of the Disclosure Hybrid Toner of Example 5. FIG. 4 shows an SEM image at 12,000× magnification of the toner surface of the Disclosure Hybrid Toner of Example 6. It is shown that the addition of the Texanol latex in the Disclosure Hybrid Toner, even at a very low concentration, such as 1% concentration and especially 5% concentration, improves the surface coalescence, resulting in a smoother surface.

What is claimed is:

1. A process for preparing a hybrid toner having a core and a shell, comprising:

mixing a first latex comprising a styrene acrylate polymer resin, a latex of an amorphous polyester wherein the amorphous polyester forming the latex obtained by reacting a diol with a diacid, a latex of a crystalline polyester, a wax, and an optional colorant to form a core mixture;

optionally adding a coagulant to the core mixture;

heating the core mixture to a temperature below the glass transition temperature of the styrene acrylate polymer resin to aggregate the core mixture to form aggregated core particles;

mixing a second latex comprising a second styrene acrylate polymer resin and a coalescent agent to form a shell mixture;

coating the shell mixture onto the aggregated core particles;

heating the shell mixture and the aggregated core particles to a temperature above the glass transition temperature of the second styrene acrylate polymer resin to coalesce the aggregated core particles to form toner particles;

and isolating the toner particles.

2. The process of claim 1, wherein the coalescent agent has a boiling point at atmospheric pressure of from about 250° C. to about 450° C.

3. The process of claim 1, wherein the coalescent agent has a volatility of from about $10^{-8}$ to about $10^{-2}$ mm Hg at 20° C.

4. The process of claim 1, wherein the coalescent agent has solubility in water of below about 0.5 weight percent.

5. The process of claim 1, wherein the coalescent agent contains at least one ester linkage.

6. The process of claim 1, wherein the coalescent agent is selected from the group consisting of 2, 2, 4-trimethyl-1,3-pentanediol monoisobutyrate, 2,2,4-trimethyl-1 ,3-pentanediol diisobutyrate, triethylene glycol di-2-ethylhexanoate, benzyl benzoate, diethylene glycol dibenzoate, 3-phenylpropyl benzoate, dipropylene glycol dibenzoate, propylene glycol dibenzoate and mixtures thereof.

7. The process of claim 1, wherein the coalescent agent comprises 2,2,4-trimethyl-1 ,3-pentanediol monoisobutyrate.

8. The process of claim 1, wherein the coalescent agent is added in an amount of from about 0.1 to about 5.0 percent by weight, based on the solid content in the shell mixture.

9. The process of claim 1, wherein the coalescent agent is only present in the shell of the hybrid toner.

10. The process of claim 1, wherein the coalescent agent does not evaporate during subsequent processing, such that the coalescent agent is present in the hybrid toner particles in an amount of about 0.01 to about 2.0 percent by weight, based on the final dry weight of the hybrid toner particles.

11. The process of claim 1, wherein the styrene acrylate polymer resin of the first latex and the styrene second acrylate polymer resin of the second latex are independently selected from the group consisting of poly(styrene-alkyl acrylate), poly(styrene-alkyl methacrylate), poly(styrene-alkyl acrylate-acrylic acid), poly(styrene-alkyl methacrylate-acrylic acid), poly(styrene-propyl acrylate), poly( styrene-butyl acrylate), poly(styrene-butyl acrylate-acrylic acid), poly(styrene-butyl acrylate-methacrylic acid), poly (styrene-butyl acrylate-acrylonitrile), poly(styrene-butyl acrylate-acrylonitrile-acrylic acid), and combinations thereof.

12. The process of claim 1, wherein the heating of the core mixture is at a temperature from about 40° c to about 60° C.

13. The process of claim 1, wherein the heating of the core mixture is conducted for about 15 minutes to about 2 hours.

14. The process of claim 1, wherein the heating of the shell mixture and the aggregated core particles is at a temperature from about 65° C. to about 90° C.

15. The process of claim 1, wherein the heating of the shell mixture and the aggregated core particles is conducted for about 15 minutes to about 4 hours.

16. The process of claim 1, wherein the coagulant is present in the hybrid toner particles, and on a dry weight basis, in an amount of from 0 to about 5% by weight of the hybrid toner particles and is selected from the group consisting of polyaluminum halides, polyaluminum silicates, polyaluminum hydroxides, and polyaluminum phosphate.

17. The process of claim 1, wherein the toner particles have a surface area of about 1.3 to about 6.5 m2/g.

18. The process of claim 1, wherein the coalescent agent is only present in the shell of the hybrid toner.

19. A process for preparing a hybrid toner having a core and a shell, comprising:

mixing a first latex comprising a styrene acrylate polymer resin, a latex of an amorphous polyester wherein the amorphous polyester forming the latex is obtained by reacting a diol with a diacid, a crystalline polyester latex, an optional colorant and an optional wax to form a core mixture;

optionally adding a coagulant to the core mixture;

heating the core mixture to a temperature below the glass transition temperature of the styrene acrylate polymer resin to aggregate the core mixture to form aggregated core particles;

mixing a second latex comprising a second styrene acrylate polymer resin and 2,2,4-trimethyl-1 ,3-pentanediol monoisobutyrate to form a shell mixture;

coating the shell mixture onto the aggregated core particles;

heating the shell mixture and the aggregated core particles to a temperature above the glass transition temperature of the second styrene acrylate polymer resin to coalesce the aggregated core particles to form toner particles; and isolating the toner particles.

20. The process of claim 19, wherein the coalescent agent is added in an amount of from about 0.1 to about 5.0 percent by weight, based on the solid content in the shell mixture.

* * * * *